US006202862B1

(12) United States Patent
Acquaviva et al.

(10) Patent No.: US 6,202,862 B1
(45) Date of Patent: Mar. 20, 2001

(54) TUBULAR YIELDING HOLDER FOR VARIOUS SIZE PENS

(76) Inventors: David Paul Acquaviva; Nick Anthony Acquaviva, both of 1515 Maidstore Pl., Bakersfield, CA (US) 93311

( * ) Notice: Subject to any disclaimer, the term of this patent is extended or adjusted under 35 U.S.C. 154(b) by 0 days.

(21) Appl. No.: 09/392,064

(22) Filed: Sep. 8, 1999

(51) Int. Cl.[7] ..... A47F 5/00; A47F 7/00

(52) U.S. Cl. ..... 211/69.5; 211/60.1; 211/69; 211/70.6

(58) Field of Search ..... 211/60.1, 89.01, 211/74, 69, 70.6, 69.5, 69.1

(56) References Cited

U.S. PATENT DOCUMENTS

| | | | | |
|---|---|---|---|---|
| 1,620,529 | | 3/1927 | Ferris . | |
| 1,641,829 | | 9/1927 | Sheaffer . | |
| 1,641,846 | | 9/1927 | Fremon et al. . | |
| 1,762,104 | | 6/1930 | Liddell . | |
| 1,789,439 | | 1/1931 | Horix . | |
| 1,804,120 | | 5/1931 | Sengbusch . | |
| 2,011,040 | | 8/1935 | Cuthbert . | |
| 2,082,831 | | 6/1937 | Hansen . | |
| 2,957,270 | * | 10/1960 | Kennamer . | |
| 3,428,380 | | 2/1969 | Danjczek . | |
| 3,476,257 | * | 11/1969 | O'Connell . | |
| 3,866,992 | | 2/1975 | Katz . | |
| 4,253,830 | * | 3/1981 | Kazen et al. | 211/69 X |
| 4,493,575 | | 1/1985 | Mutschler . | |
| 4,826,338 | * | 5/1989 | Kilpatrick | 211/69.1 X |
| 5,033,629 | | 7/1991 | Caine . | |
| 5,163,549 | | 11/1992 | Hayduchok . | |
| 5,188,242 | * | 2/1993 | Smith | 211/69 |
| 5,405,024 | | 4/1995 | Sahf . | |
| 5,447,243 | * | 9/1995 | Graber | 211/69.5 |
| 5,601,194 | * | 2/1997 | Brinston | 211/60.1 X |
| 5,823,363 | * | 10/1998 | Cassel | 211/60.1 |
| 5,850,917 | * | 12/1998 | Denton et al. | 211/60.1 X |
| 5,961,927 | * | 10/1999 | Isaacs et al. | 211/60.1 X |

* cited by examiner

*Primary Examiner*—Robert W. Gibson, Jr.

(57) ABSTRACT

A pen holder (22) comprising six tapered tubular cavities (24) for holding and sealing various size pens, is formed in a resilient foam (28) cooperating with a skin (30) that surrounds all outside surfaces. The resilient materials are flexible enough to hold pens against the tapered section without loosening. Tapered tubular cavity (24) has a mouth (42) that is connected to a throat (44). Throat (44) leads to a primary gripping zone (46) that connects to a secondary gripping zone (48). The gripping zones have different tapered ranges to accommodate different pen widths. Foam (28) and skin (30) surrounds tapered tubular cavities (24) forming an outside block shape with a face (32) that comprises six mouths (42) exposed in face (32). Face (32) is parallel to a base (34). The block shape comprises two concave sides (36A) and (36B). Pen holder (22) comprises two waist walls (38A) (38B) that are perpendicular to concave sides (36A) and (36B). Pen holder (22) can be held in a human being's hand during operation or can be held by a wall bracket (62). In addition, pen holder (22) has an eraser well (26) that comprises two short walls (56A) and (56B) which are tapered to hold a conventional eraser (78). Eraser well (26) comprises two side walls (58A) and (58B) that are perpendicular to a end wall (60). End wall (60) is parallel to a port (54) which is exposed in face (32) of pen holder (22).

13 Claims, 7 Drawing Sheets

32
15
38B
15
56A
58B
54
17
26
19
58A
56B
19
17
30
36B
36A
60
40C
28
30
24
38A
40A
34
22

TUBULAR YIELDING HOLDER FOR VARIOUS SIZE PENS

BACKGROUND

1, Field of Invention

This invention relates to pen holders, specifically to such holders which are used for holding pens of various size.

2. Description of Prior Art

Pen manufacturers commonly supply consumers with pens that have different sizes, lengths, and degrees of slope along the pen length. Pen manufactures often equip pen models with a mating cap to prevent evaporation of ink.

These pens require the use of two hands for removing caps before writing. Conversely, after writing, the caps need to be installed to prevent drying of ink. However, writers objected because the act of using a cap in such a manner becomes tedious.

Thereafter, inventors created pen holders to facilitate one-hand operation for writing. U.S. Pat. No. 5,405,024 to Sahf (1995) discloses a complex rack with an internal groove for a ring seal. However, ink can easily contaminate the seal precluding the use of different colors of ink pens. U.S. Pat. No. 5,163,549 to Hayduchok (1992) shows a hollow rigid modular pen holder system. However, this system requires a close tolerance between the pen and the holder. U.S. Pat. No. 5,033,629 to Caine (1991) demonstrates a thin resilient cylindrical sleeve mounted in a rigid box. However, the round inner sleeve area has a static unbiased hole size. Thus, the seal must compress with ever greater pressure when pens of larger sizes are inserted . Also, pens must be kept in a upright position to prevent toppling precluding portable hand-held use of holder while writing. Finally, Caine's pen holder grips pens at the tip diameter increasing the risk of ink contamination. U.S. Pat. No. 4,493,575 to Mutschler (1985) employs an internal tapered sleeve attached at one end only. However, the sleeve can be pulled out of holder along with pen unless sleeve is rigid. U.S. Pat. No. to Kennamer 2,957,270 (1960) shows a solid block that slides on a track with a plurality of cavities therein. However, the solid block needs to be of a rigid low friction material so as to be able to slide on dovetail rib. U.S. Pat. No. 2,082,831 to Hansen (1935), U.S. Pat. No. 1,789,439 to Horix (1926), and U.S. Pat. No. 1,641,829 to Sheaffer Walter and Sheaffer Craig (1924) illustrate sleeves mounted to a base at one end. However, the sleeves need to be made of a rigid material to prevent collapse when pens are inserted. U.S. Pat. No. 2,011,040 to Cuthbert (1935) and U.S. Pat. No. 1,804,120 to Sengbusch (1927) document complex multiple part holders that use resilient gripping fingers to accommodate different size pens. However, these configurations would be prohibitively expensive to manufacture. U.S. Pat. No. 1,762,104 to Liddell (1928) divulges a sleeve attached at one end with a series of inner-stepped recesses. However, the shoulder of the pen abuts on top of the recess requiring gravity to maintain upright position. Also, holder cannot maintain pens in horizontal position without toppling and falling out. U.S. Pat. No. 1,641,846 to Fremon Jules and De Haven Avery (1927) embodies a rubber cylindrical sleeve with an internal shoulder and a flared open end. However, the shoulder of pen sits on top of the internal shoulder in a loose fashion thus requiring a vertical position. U.S. Pat. No. 1,620,529 to Ferris (1927) presents a rubber sleeve inserted into a base. However, the sleeve has an axial internal groove preventing an airtight seal. Also, different size pens are accommodated by using a new sleeve with mating size bore. U.S. Pat. No. 3,866,992 to Katz (1975) and U.S. Pat. No. 3,428,380 to Danjczek (1969) displays tubular elements seated in a container filled with water. However, tubular elements do not provide a perfect airtight seal. U.S. Pat. No. to 5,850,917 Denton (1998) shows a box with cavities therein. However, Denton teaches that his box is rigid and requires a foam liner to hold syringes of different diameters. Additionally, Denton explains that the holder is designed to hold syringes with a sterile cap over a hypodermic needle. Also, Denton's syringe holder does not compensate for the effect that various syringe widths have on the ratio of protruding syringe length to inserted syringe length. U.S. Pat. No. to 4,253,830 Kazen (1981) cites a resilient cylindrical tapered stepped sleeve inserted into a rigid box. Nevertheless, the sleeve encompasses a constricting aperture wall that results in an unbiased static hole. Also, Kazen has designed the holder to continuously vent to atmosphere so that dental instruments will not corrode in the holder.

All of the pen holders mentioned attempt to solve the objections of writers, nevertheless all of the pen holders heretofore known endure from a number of disadvantages:

(a) The tubular side wall of the holders in the present do not have a constant yielding frictional engagement with pens of different sizes. Such holders require ever increasing force to insert pens of larger sizes therein. Such increasing pressure on holder requires the use of reinforced fastening system to prevent holder from moving. Also, such holders are limited to permanent fixtures that will not move. Portable devices such as easels or tripods need to be permanently attached to the earth. Pens cannot be pulled out of the holder by grasping cap attached to end of barrel without detachment. Conversely, such holders cannot maintain minimum frictional engagement to facilitate pen release. Pens of smaller sizes result in ever decreasing holding force on pens. Smaller pens require the holder to be mounted in a vertical position to prevent pens from toppling or falling out. Also, such holders cannot maintain an airtight seal around pens of various size so that only minimum force is need to substantiate a perfect seal. Such holders do not readily allow consumers to buy different pen models which will work in such holders with consistent performance. Finally, variance in frictional engagement requires a writer to accommodate to different insertion and release pressures of various pens from holder.

(b) In present holders, the marking tips of pens can easily touch the inner wall of tubular holder. If one uses pens with different ink colors the holder must be cleaned prior to insertion. Such holders engage pens at their tip. The use of a plurality of holders with different color pens requires assignment of each pen to an exclusive holder to prevent cross contamination of ink. Such holders decrease writing speed when writers dedicate a specific color pen to an addressed holder.

(c) Present tubular holders do not compensate for the effect that various pen widths have on the ratio of protruding pen length to inserted pen length. Pens of narrow diameters will engage tubular holder deeper than pens of larger diameters. Consequently, a narrow diameter pen will have a greater percentage of its pen length inside the tubular holder than a larger diameter pen of comparable length. Accordingly, narrow pens require writers to reach a farther distance to grab pens verses a shorter distance for larger diameter pens. Reaching for pens of differing protruding lengths requires greater concentration for a writer.

(d) Pen holders of the present require the use of multiple parts and complex installations, thereby increasing cost and sales resistance for consumers. Also, multiple-part designs increase the chance for product defects.

(e) Pen holders of the present are limited to the use of rigid materials to prevent collapse. Rigid material requires that pen and holder be of mating dimensions to provide seal. Also, rigid material requires a snap fit. Mating surface between pen and holder require the use of different size holders for different size pens. The use of different size holders requires writers to put pens back in their assigned holder. Such holders require an exclusive model of pen to be used. Other pen models must remain with original caps precluding one-hand operation.

(f) The use of an internal shoulder to seat pens requires the use of gravity for pens to remain seated. Pens used in horizontal position will topple and not seat properly for airtight seal. Holders that provide annular stepped recesses to accommodate larger pens do not provide a constant yielding frictional engagement.

(g) Pen holders of the present do not allow writers or artists to handle pen holder in a palette-like fashion.

(h) Pen holders of the present do not allow writers to hold and squeeze holder in such a manner as to aid in tension release.

Objects and Advantages

Several objects and advantages that the present invention remedies are:

(a) to provide a holder which can accept many different pen models of different size with consistent performance.

(b) to provide a holder which prevents ink contamination by engaging various size pens at the barrel away from pen tip.

(c) to provide a holder which will compensate for the effect of various pen widths on the ratio of protruding pen lengths to inserted pen lengths.

(d) to provide a holder which is a singular molded part allowing for inexpensive rapid production with minimal installation for consumers.

(e) to provide a holder which is flexible with yielding properties that will hold pens of various size in a secure delicate fashion with airtight seal.

(f) to provide a holder which has a tapered tubular cavity without inner-stepped walls allowing pens to be gripped and held therein by a resilient yielding cushion in any position.

(g) to provide a holder that can be held like an artist palette to facilitate writing or drawing with various pens of different size and color.

(h) to provide a holder that can be held and squeezed to aid in tension release.

Further objects and advantages are to provide a holder which is extremely light weight, which is unbreakable, which can be attractively packaged in a clear plastic bag with reseal capabilities allowing consumers to inspect item, which requires inexpensive packaging decreasing cost for consumers, which uses inexpensive printed labels on package, which can be hung on peg board with minimal fixture support, and which can be supplied in master boxes of a standard size with lowest cost per cubic inch, without regards to total weight. Still further objects and advantages will become evident from observing the following description and drawings.

DRAWINGS FIGURES

Reference Numerals in Drawings

Figure 5A:
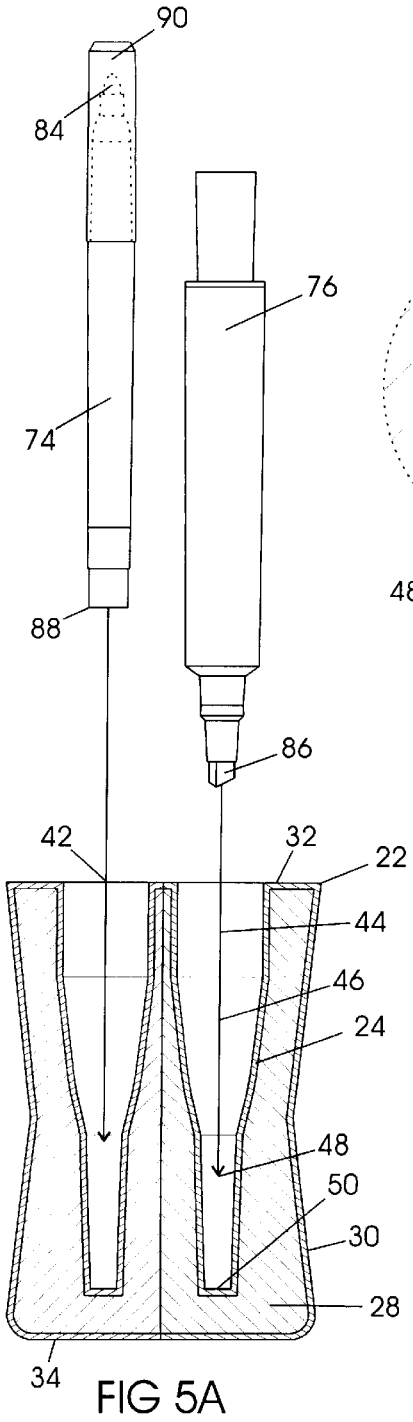
FIGS. 5A and 5B show end views of FIG. 2 and various sized pens added before and after engagement into holder.
Figure 5B:
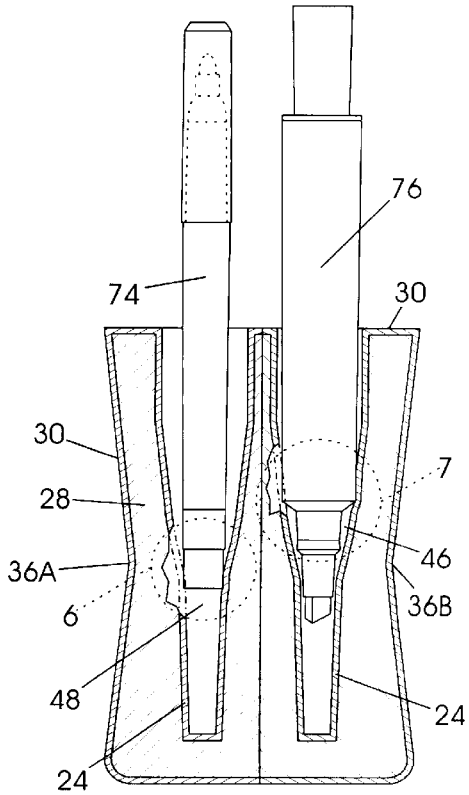

| | |
|---|---|
| 6 section of FIG. 5B | 7 section of FIG. 5B |
| 15 plane 15—15 | 17 plane 17—17 |
| 19 plane 19—19 | 21 plane 21—21 |
| 22 pen holder | 24 tapered tubular cavity |
| 26 eraser well | 28 foam |
| 30 skin | 32 face |
| 34 base | 36A and 36B concave sides |
| 38A and 38B waist walls | 40A, 40B, 40C, and 40D tapered ends |
| 42 mouth | 44 throat |
| 46 primary gripping zone | 48 secondary gripping zone |
| 50 end cap | 52 resilient cellular impermeable material |
| 54 port | 56A and 56B short walls |
| 58A and 58B long walls | 60 end wall |
| 62 wall bracket | 64 plate |
| 66A and 66B through-holes | 68A and 68B channel walls |
| 70 line segment alpha | 72 line segment beta |
| 74 round tip pen | 76 chisel tip pen |
| 78 eraser | 80 straight taper receptacle |
| 82 straight taper section | 84 round tip |
| 86 chisel tip | 88 pen butt |
| 90 pen cap | 92 joint theta |
| 94 joint delta | |

SUMMARY

In accordance with the present invention an article of manufacture for holding various size elongated implements comprises a resilient cellular material or foam defining a tapered tubular cavity with one portion open to expose the cavity to ambient atmosphere.

DESCRIPTION—FIGS 1, 2, 3, 4, 8, 9, 10, 11, 12A, 12B, 13A, 13B

Figure 1:
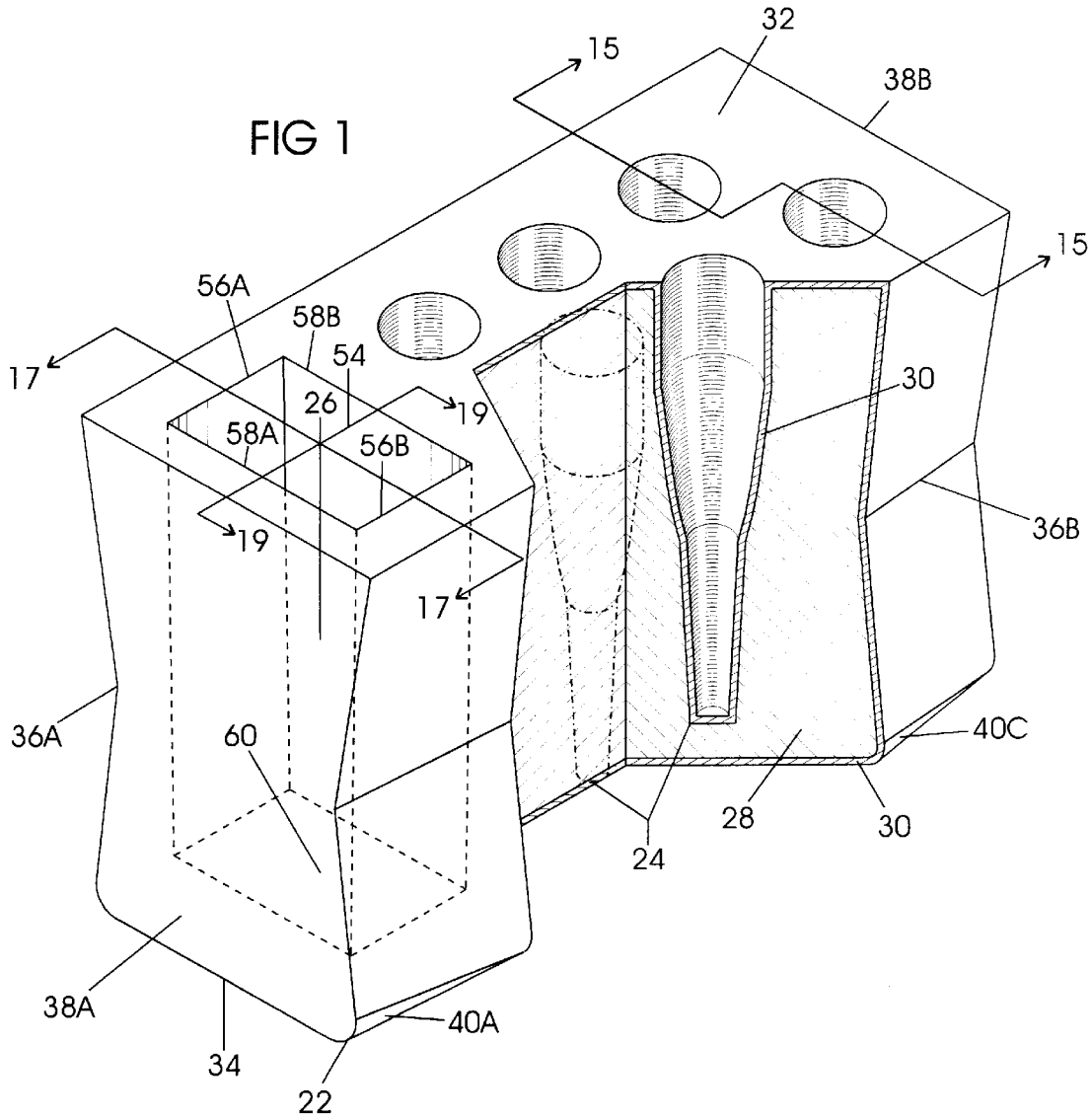
FIG. 1 shows pen holder with a internal resilient yielding material with a integral resilient yielding layer on outside surface areas.

In the preferred embodiment, a pen holder 22 of the present invention is illustrated in FIG 1. Pen holder 22 comprises six tapered tubular cavities 24. Next to tapered tubular cavities 24 is a rectangular cavity or eraser well 26. Tapered tubular cavities 24 are formed in a resilient cellular material or foam 28 that has a resilient yielding integral layer or skin 30 on all surface areas.

Figure 4:
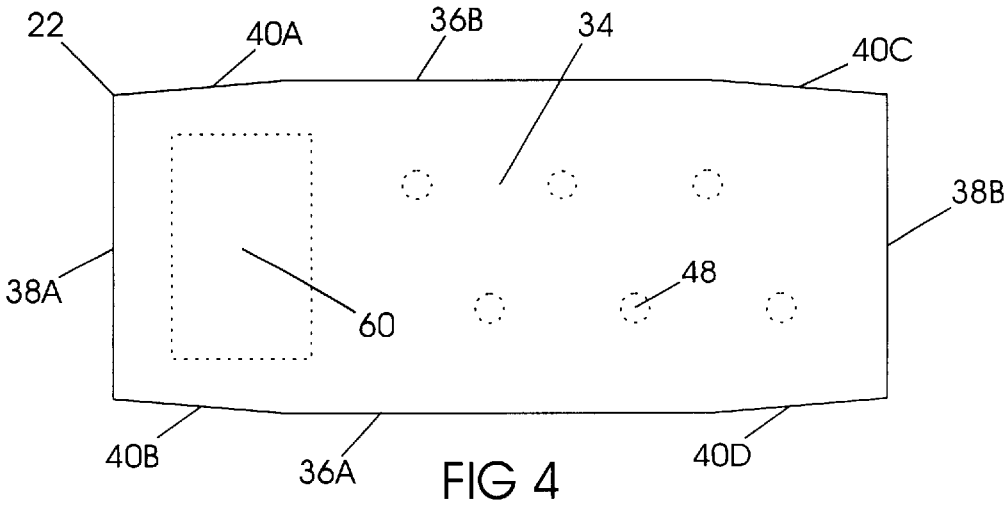
FIG. 4 is bottom view of pen holder.

In the preferred embodiment, pen holder 22 is formed in a mold that has a cavity image therein of the present embodiment. Pen holder 22 has a flat top or face 32 and a flat bottom or base 34. Face 32 is parallel to base 34. holder 22 comprises two concave sides 36A and 36B. Concave side 36A mirrors concave side 36B. Pen holder 22 comprises two hourglass shaped end walls or waist walls 38A and 38B. Base 34 of pen holder 22 in FIG. 4 (bottom view) comprises four tapered ends 40A, 40B, 40C, and 40D. Tapered ends 40A and 40B begin to narrow from concave side 36B and 36A, respectively, toward waist wall 38A. In like fashion, tapered ends 40C and 40D begin to narrow from concave sides 36B and 36A, respectively, toward waist wall 38B. In the preferred embodiment (FIG. 1), foam 28 and skin 30 are a polyurethane with skin 30 formed during the molding process. However, foam 28 and skin 30 can be made of any other material and process and combination thereof that will provide foam 28 with resilient yielding properties that will cooperate with skin 30 with resilient yielding properties. For example, skin 30 can be sprayed on to the cavity image before foam 28 is injected into the mold. Additionally, skin 30 can be molded in a separate operation and thereupon inserted into the mold of cavity image, where foam 28 is injected on to skin 30 resulting in fusion of skin 30 to foam 28.

Figure 2:
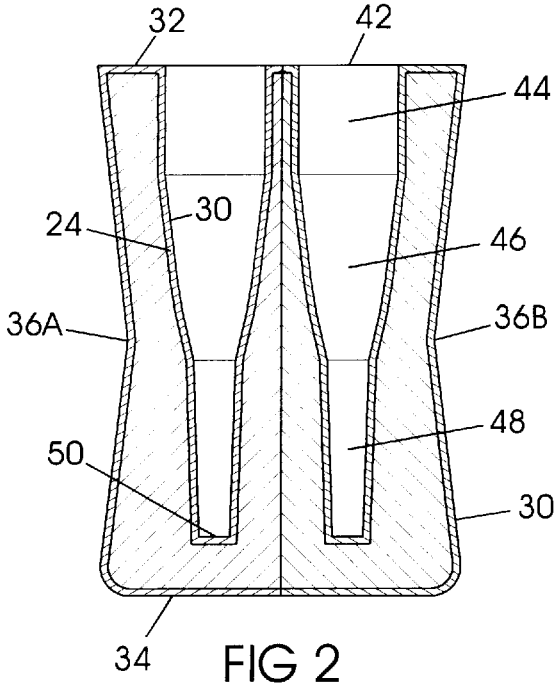
FIG. 2 is a cross section end view of the stepped parallel plane 15—15 in FIG. 1 with half of tapered tubular cavities exposed.

Tapered tubular cavities 24 in FIG. 2 (vertical stepped plane 15—15 of FIG. 1) have a round open horizontal end section or mouth 42 which is the widest horizontal cross section of tapered tubular cavity 24. Mouth 42 is connected to a vertical parallel section or throat 44 that runs the same width as mouth 42. Throat 44 is connected to a vertical tapered section or primary gripping zone 46. Primary gripping zone 46 has a taper that forms a vertical rise in height which is greater than the horizontal length in run. Primary gripping zone 46 is connected to a secondary gripping zone 48 which has a vertical taper which is slightly steeper than primary gripping zone 46. Secondary gripping zone 48 is connected to a round flat bottom or end cap 50. Tapered tubular cavity 24 has a smooth transition with no shoulder between throat 44, primary gripping zone 46, and secondary gripping zone 48.

Figure 3:
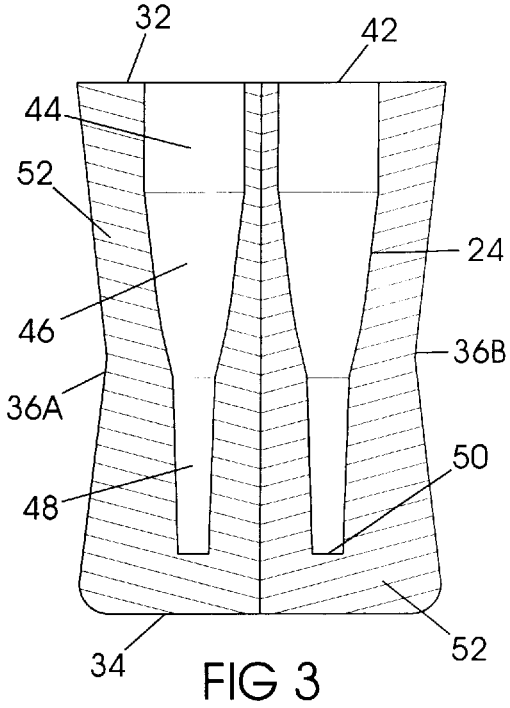
FIG. 3 is a partial end view of FIG. 2 without an integral yielding skin.

An alternate embodiment (FIG. 3 cross section plan view) shows a resilient cellular impermeable material 52 such as a polyethylene closed-cell foam without an integral skin. However, resilient cellular impermeable material 52 can be made of any other type of closed-cell material that will prevent evaporation of ink solvents. The internal surface area of tapered tubular cavity 24 is the same amount as in the preferred embodiment.

Figure 11:
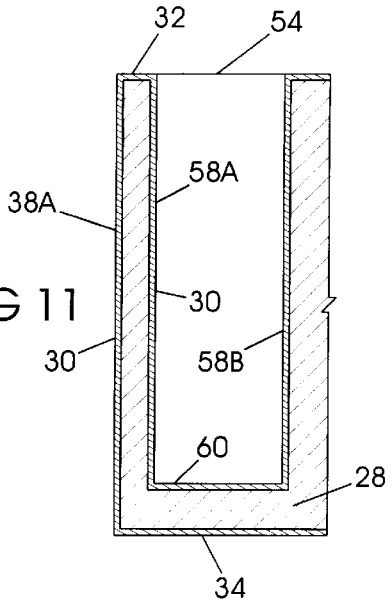
FIG. 11 shows eraser port cross section end view of plane 19—19 in FIG. 1.
Figure 10:
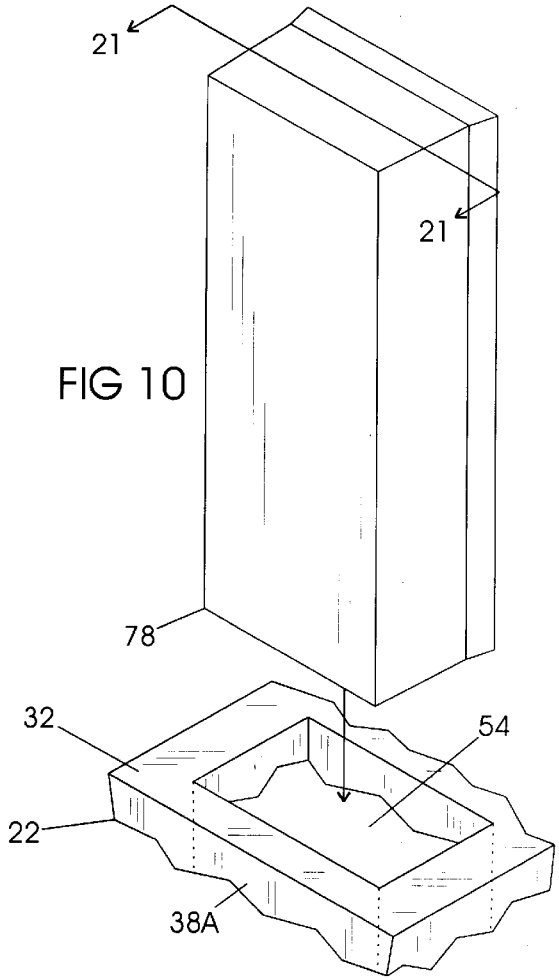
FIG. 10 shows a conventional marker board eraser with a partial view of pen holder and eraser well.
Figure 12A:
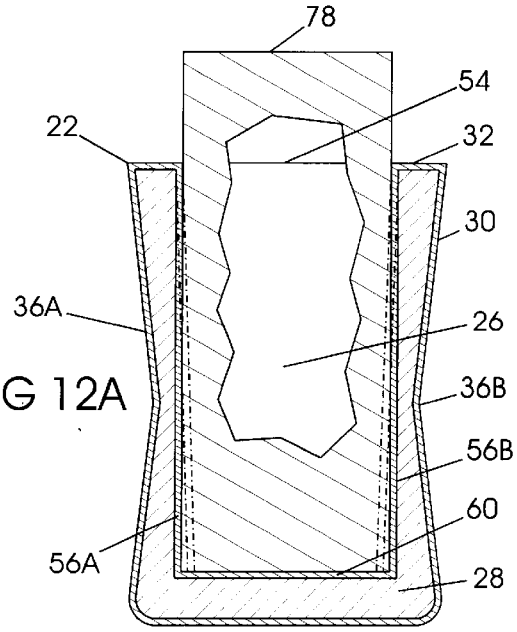
FIG. 12A shows cross section end view of eraser (plane 21—21 in FIG. 10) and eraser well (FIG. 12B) engaged.
Figure 12B:
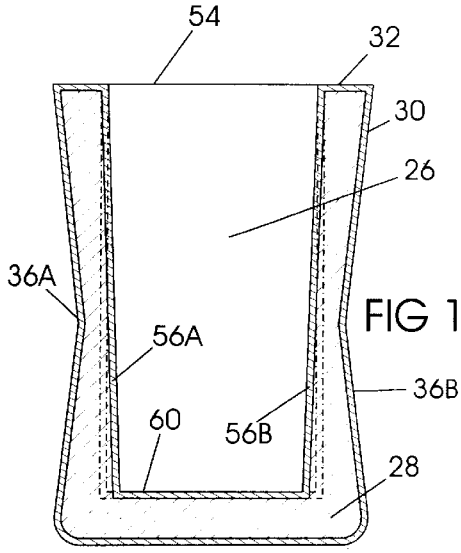
FIG. 12B is a cross section end view of plane 17—17 in FIG. 1 with half of eraser well exposed.

Eraser well 26 in FIG. 1 has a horizontal open end or port 54. Port 54 is rectangular is shape. Eraser well 26 comprises two narrow side walls or short walls 56A and 56B that are connected at the opposite narrow ends of port 54. Eraser well 26 comprises two wide side walls or long walls 58A and 58B that are connected at the opposite wide ends of port 54. The side walls are connected to a rectangular flat bottom or end wall 60. In FIG. 11 (vertical plane 19—19 of FIG. 1) long walls 58A and 58B are opposite each other and are vertical and perpendicular to end wall 60. In FIG. 12B (vertical plane 17—17 of FIG. 1) short walls 56A and 56B are opposite each and begin to taper from port 54 inward toward end wall 60. End wall 60 has a perimeter less than port 54 (without implement inserted). In FIG. 12A (FIG. 12B with cross section of eraser 78 from vertical plane 21—21 of FIG. 10 added) eraser 78 is shown engaged in eraser well 26 of pen holder 22.

Figure 13A:
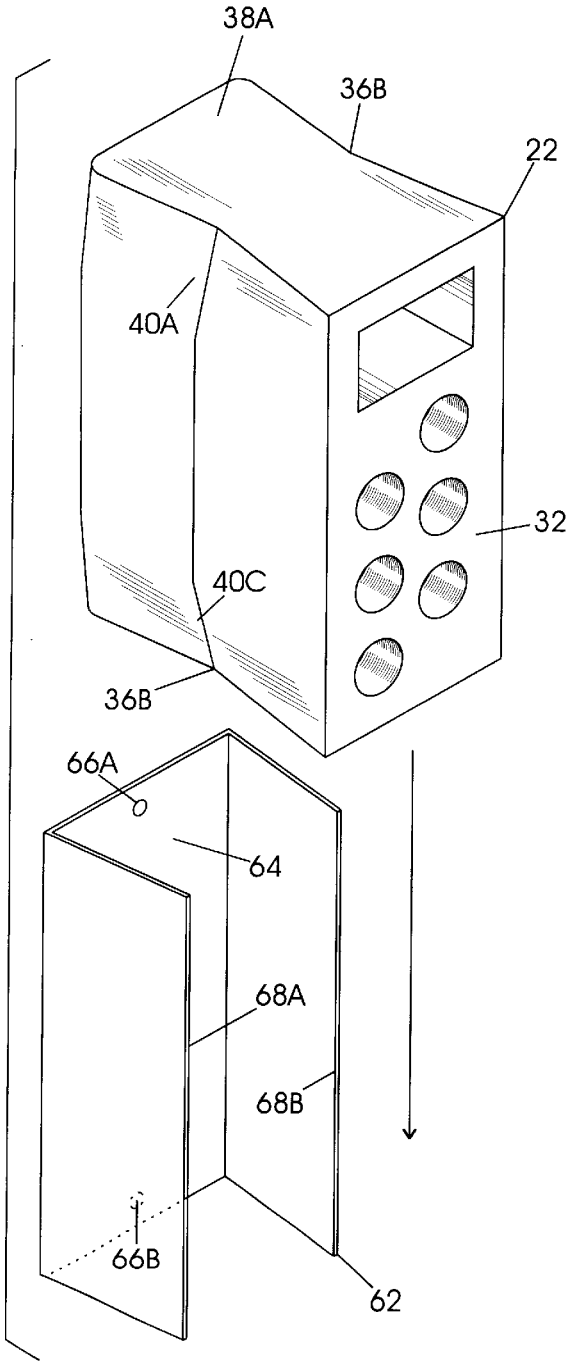
FIGS. 13A and 13B show pen holder before and after engagement into a wall bracket.
Figure 13B:
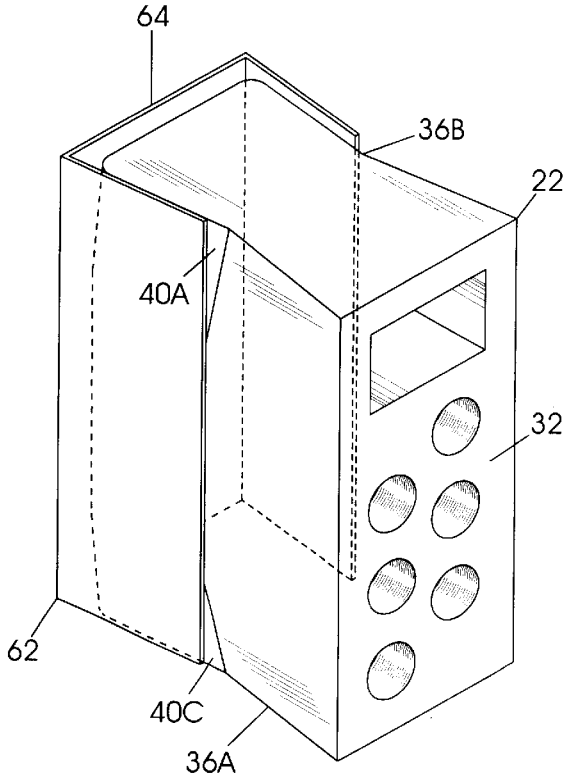

In FIGS. 13A and 13B pen holder 22 can be held in a wall bracket 62. Wall bracket 62 has a flat bottom or plate 64. Plate 64 has a through-hole 66A and 66B at each end for screw or nail attachment to a planar surface. Plate 64 can be attached to a planar surface using adhesive tape, or suction cups (not shown). Wall bracket 62 comprises two channel walls 68A and 68B. Plate 64 is connected to channel walls 68A and 68B. Channel walls 68A and 68B begin to taper from plate 64 inwards toward each other forming an opening that is slightly narrower than the width of pen holder 22.

Figure 8:
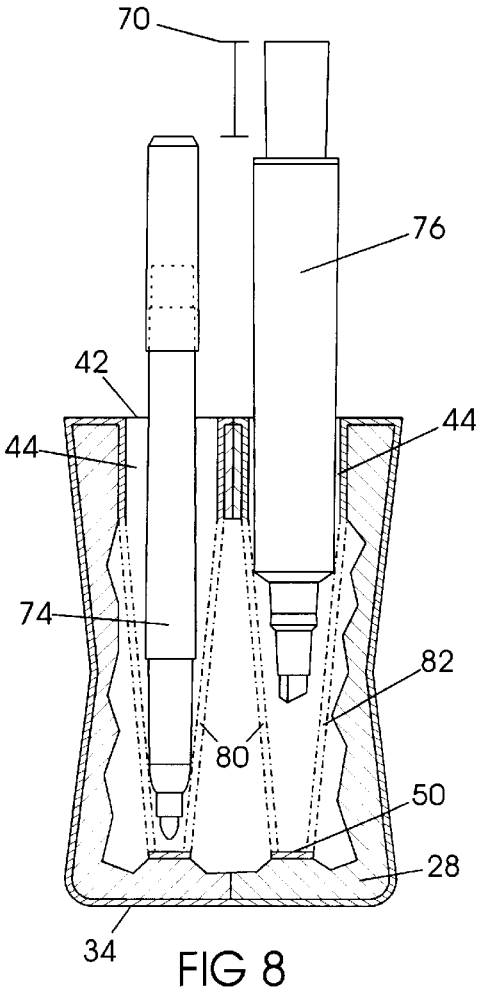
FIG. 8 shows a cut away view of FIG. 9 with phantom straight tapered tubular receptacles and various size pens added.
Figure 9:
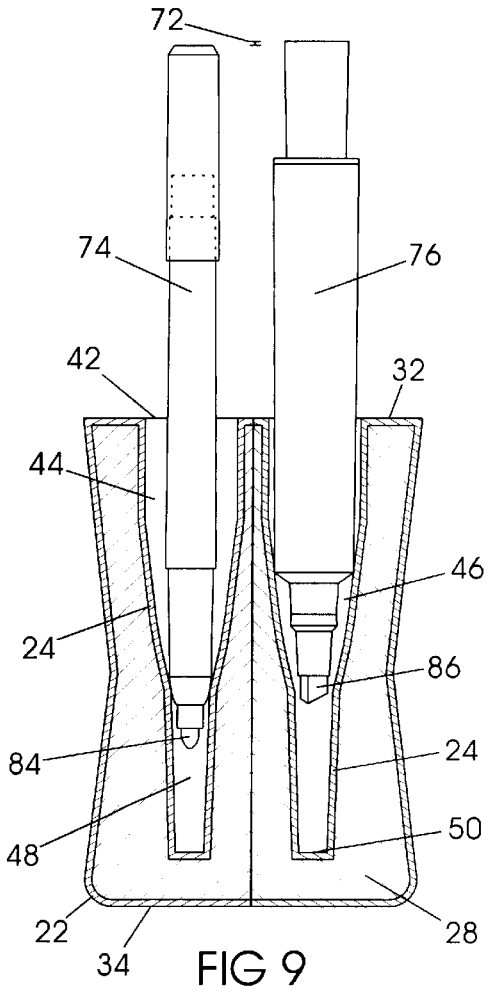
FIG. 9 shows end view of FIG. 2 and various size pens added.

The display in FIG. 8 (cut away of FIG. 9 with alternate embodiment in phantom lines) shows a straight taper receptacle 80. Straight taper receptacle 80 has the same mouth 42 as shown in tapered tubular cavity 24 (FIG. 9). Mouth 42 is connected to the same throat 44 as shown in tapered tubular cavity 24. Throat 44 is connected to a straight taper section 82. Straight taper section 82 is connected to the same end cap 50 shown in tapered tubular cavity 24. The vertical rise in height of straight taper section 82 is equal to the combined vertical rise in height of primary gripping zone 46 and secondary gripping zone 48 (FIG. 9). Round tip pen 74 and chisel tip pen 76 are shown inserted into straight taper receptacles 80. Line segment alpha 70 represents the variance in length between round tip pen 74 and chisel tip pen 76 when implements are inserted into straight taper receptacles 80.

In FIG. 9 round tip pen 74 and chisel tip pen 76 are shown inserted into pen holder 22 (FIG. 2 with implements added). Line segment beta 72 represents the variance between round tip pen 74 and chisel tip pen 76 when the implements are inserted into pen holder 22.

From the description outlined above, numerous advantages of our pen holder become evident:

(a) The same pen holder will be able to hold many different types of pen models, eliminating the need for manufacturing standards of pen size, length, and slope along the barrel. Thus, consumers can purchase pens based on other factors such as price, color, and style. With the use of a plurality of identical tapered tubular cavities to hold a infinite number of pen models, consumers will be able to use several different pen models concurrently without the need of returning a specific pen model to a exclusive tapered tubular cavity. Thus, writing speed will increase when several different pen models are used in conjunction.

(b) Tapered tubular cavities that grip various pen models away from the tip permit users to exchange pen models of different color into adjacent tapered tubular cavities, without the need to clean the inside of tapered tubular cavities. Thus, cross contamination of inks can easily be avoided.

(c) Tapered tubular cavities that compensate for the effect of different pen widths on protruding pen lengths, allow users to switch pen models of different widths into adjacent tapered tubular cavities without the sacrifice of appearance. Thus, uniform appearance of inserted pens is easily maintained. Also, pens that are uniform in appearance are easier to grasp because users do not have to reach between and below adjacent pens in order to grasp a narrow pen. Additionally, multi-tapered tubular cavities provides better support for pens by decreasing the variance depth at which different pen widths engage tapered tubular cavities. Pens of different widths engage multi-tapered tubular cavities near the center depth. Thus, the effect from different pen widths on the protruding height of pens is minimized.

(d) A single molded part requires no pre-assembly. Pen holders made in this fashion require less time per unit of manufacture. Also, single molded parts significantly reduce probability of defects.

(e) The use of foam to form tapered tubular cavities allows for an increase in tolerance between pen and tapered tubular cavity. Therefore, pens will suspend and seal against tapered tubular cavity even though the taper value of pen does not match taper value of tapered tubular holder, without the sacrifice of loosening or drying out. Pens can have a slope value that is zero, positive, or negative in comparison to tapered tubular cavity. Also, foam allows pen holder to resist breaking.

(f) The use of foam allows tapered tubular cavity to omit the use of a shoulder to seal the pen. Foam allows tapered tubular cavity to grip and suspend pen in any position.

(g) The hand-held capability of pen holder allows for superior ergonomic control for a user to insert and grasp implements. Users can naturally position pen holder so that the implements line up with the grasping hand.

Although pen holders made of rigid materials can be hand-held per se, the use of foam material in our pen holder will provide a pen holder that is light weight and comfortable with a nonslip surface.

(h) Pen holders made of foam material allow users to squeeze pen holder in the hand. This produces a custom fit in user's hand. Also, pen holder can be manipulated to aid in stress relief.

OPERATIONS—FIGS 5A, 5B, 6, 7, 8, 9, 10, 12A, 13A, 13B, 14

Figure 6:
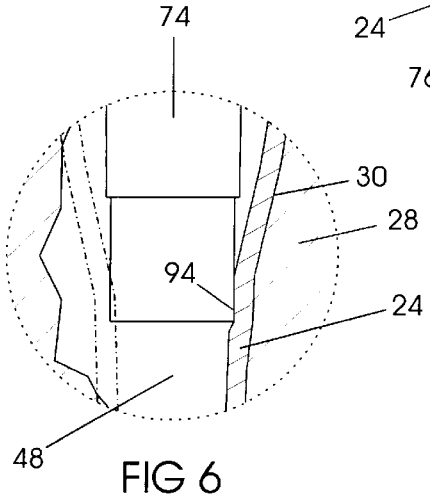
FIG. 6 is an enlarged section of reference 6 of FIG. 5B.
Figure 7:
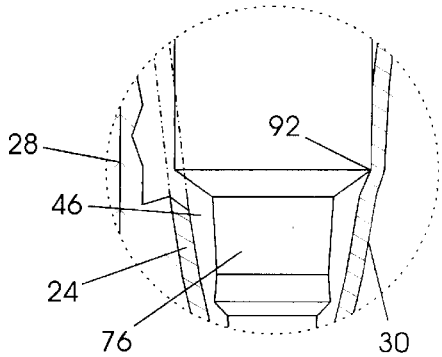
FIG. 7 is an enlarged section of reference 7 of FIG. 5B.

The manner of using pen holder 22 is similar to pen racks of present day use. Specifically, one first removes a cap from a pen and either discards cap or affixes the cap to the end of the pen barrel in normal fashion. As shown in FIGS. 5A and 5B (FIG. 2 with implements added) chisel tip pen 76 is inserted into pen holder 22 with chisel tip 86 pointing toward tapered tubular cavity 24 until chisel tip pen 76 reaches a interference fit with tapered tubular cavity 24. It is possible for one to insert a pen such as round tip pen 74 into pen holder 22 with pen butt 88 pointing toward tapered tubular cavity 24 with pen cap 90 covering round tip 84. The interference fit of joint theta 92 of chisel tip pen 76 in FIG. 7 (reference 7 of FIG. 5B) shows a deflection in tapered tubular cavity 24 of primary gripping zone 46. The interference fit of joint delta 94 of round tip pen 74 in FIG. 6 (reference 6 of FIG. 5B) shows a deflection in tapered tubular cavity 24 of secondary gripping zone 48. As can be seen, the expansion of primary gripping zone 46 (FIG. 7) and secondary gripping zone 48 (FIG. 6) is similar in the amount of deflection between both tapered tubular cavities 24. The uniform deflection pressure upon chisel tip pen 76 (FIG. 7) and round tip pen 74 (FIG. 6) allows for different pen models of various size and slope along the barrel to be inserted and removed from pen holder 22 with minimum force and consistent performance. The interference fit between the implements and tapered tubular cavities 24 is enough pressure for user to hold pen holder 22 in any position without the implements becoming loose from gravity or centrifugal force. The interference fit between tapered tubular cavities 24 and the implements produces an airtight seal around the implements.

Figure 14:
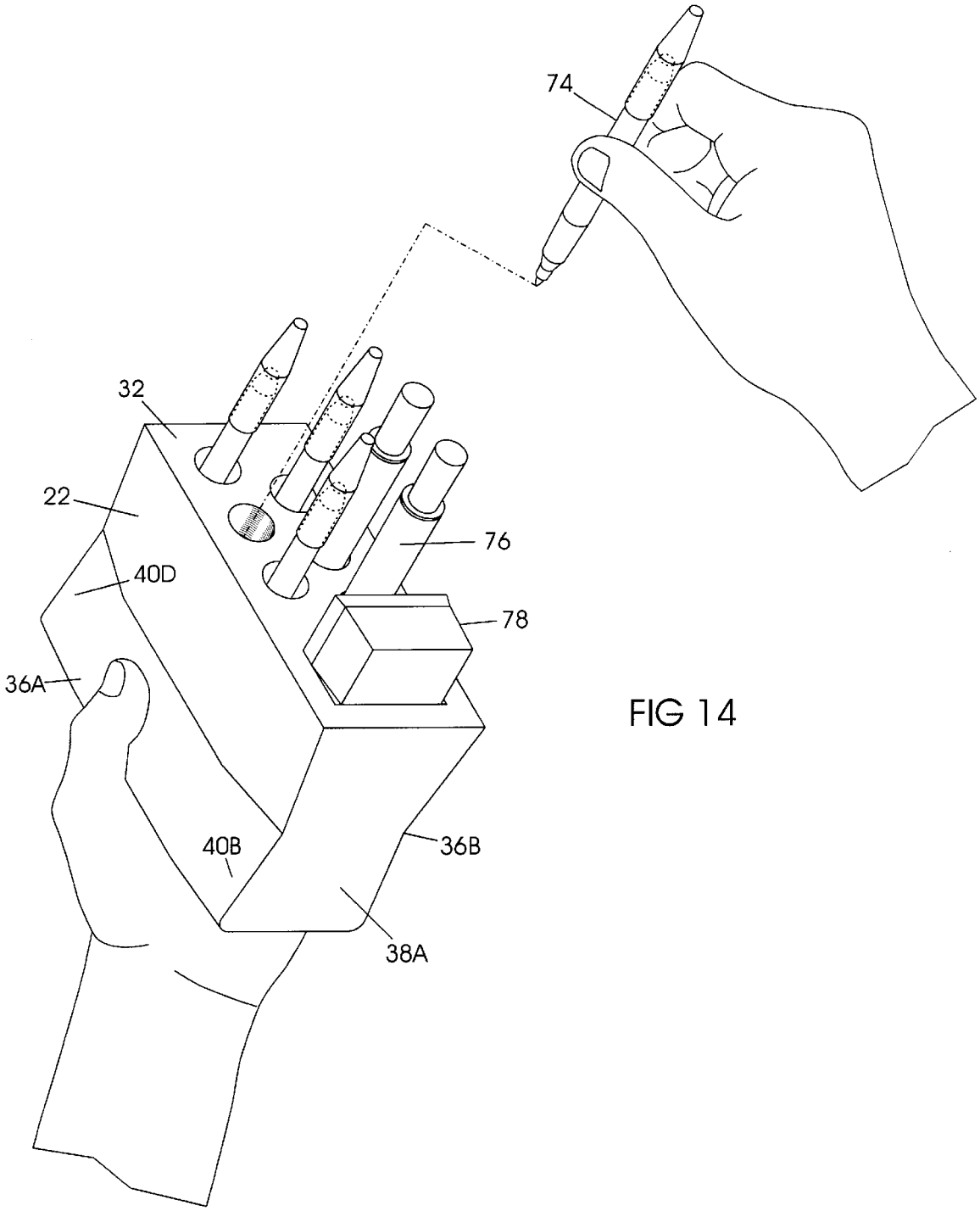
FIG. 14 shows pen holder being held like an artist palette by user.

To remove a pen inserted into pen holder 22 one simply grasps the exposed portion of a pen and pulls the pen loose from pen holder 22 as shown in FIG. 14.

As shown in FIG. 9 round tip pen 74 and chisel tip pen 76 are inserted into pen holder 22 with both round tip 84 and chisel tip 86 inside tapered tubular cavities 24. It can be seen that the implements are tangent to tapered tubular cavities 24 with both round tip 84 and chisel tip 86 free and clear from the internal wall of tapered tubular cavity 24.

In FIG. 8 line segment alpha 70 is the variance between round tip pen 74 and chisel tip pen 76 when the implements are tangent to straight taper section 82. Straight taper section 82 grips chisel tip pen 76 just below throat 44 and grips round tip pen 74 just above end cap 50.

In FIG. 9 line segment beta 72 is the variance between round tip pen 74 and chisel tip pen 76 when the implements are tangent to tapered tubular cavities 24. Tapered tubular cavity 24 grips chisel tip pen 76 at primary gripping zone 46 and grips round tip pen 74 at secondary gripping zone 48.

To store eraser 78 (FIGS. 10 and 12A) in pen holder 22 one inserts eraser 78 into port 54 until eraser 78 becomes tangent with end wall 60. When eraser 78 is inserted into eraser well 26 short walls 56A and 56B expand against foam 28. Short walls 56A and 56B become tangent with eraser 78 and apply pressure to eraser 78. The pressure applied to eraser 78 is enough pressure to hold eraser 78 firmly into eraser well 26 allowing pen holder 22 to be held in any position without eraser 78 becoming disengaged from eraser well 26 by gravity or centrifugal force.

To use eraser 78 one grasp the exposed portion of eraser 78 and pulls eraser 78 from eraser well 26 as shown in FIG. 14.

To temporarily hold pen holder 22 to a planar surface one can use a wall bracket 62. Wall bracket 62 in FIGS. 13A and 13B is used to hold pen holder 22 against a planar surface. Wall bracket 62 can be mounted to a planar surface by a mechanical fastener such as a screw or nail (not shown). Wall bracket 62 can be attached to a planar surface by using a hook-and-loop or adhesive tape system (not shown). Through-hole 66A and 66B located at each end of plate 64 can be used to fasten wall bracket 62 to a planar surface. When wall bracket 62 is fastened against a planar surface, pen holder 22 can be inserted into wall bracket 62 using one hand. Tapered ends 40A, 40B, 40C, and 40D of pen holder 22 help to guide pen holder 22 into wall bracket 62. Channel wall 68A and 68B holds pen holder 22 at concave sides 36A and 36B. Channel walls 68A and 68B have slightly steeper taper than pen holder 22 causing an interference fit. The interference fit allows channel walls 68A and 68B to hold pen holder 22 tight enough to prevent gravity or centrifugal force from loosing pen holder 22 from wall bracket 62 (with implements inserted). Pen holder 22 can be removed from wall bracket 62 by grasping the exposed portion of pen holder 22 and sliding the holder against channel walls 68A and 68B toward the open end of the wall bracket 62.

It is possible to temporarily fasten pen holder 22 to a planar surface without the use of wall bracket 62 by using a hook-and-loop fastening system (not shown). Also, pen holder 22 can be fastened to a planar surface by using an adhesive tape (not shown).

Pen holder 22 can be held like an artist palette as shown in FIG. 14. A writer or artist uses one hand to hold pen holder 22. The other hand is free to grasp a pen, such as round tip pen 74. Using pen holder 22 like an artist palette allows a writer or artist to remain in close proximity to pen holder 22. The close proximity of pen holder 22 to its user allows a writer or artist to ergonomically control the position at which pens are selected. Pen holder 22 can be squeezed in an ergonomic manner to produce a custom fit in a users hand.

Summary, Ramifications, and Scope

Accordingly, the reader will understand that the pen holder of this invention can be used to hold pens easily and conveniently, can display pens in an ascetic manner, and can aid user in successive use of various pens. In addition, the pen holder can contour to a user's hand. Furthermore, the pen holder has the additional features in that:

it permits the use of various size pens without requiring a manufacturer to produce a specific pen model to use in conjunction with pen holder;

it permits the use of different color pens without the need to clean pen holder;

it counteracts the effect of various pen widths on protruding pen lengths inserted therein, providing a uniform appearance;

it allows rapid manufacturing techniques to be employed;

it provides reliability to hold and seal pens of various sizes;

it provides stability of inserted pens without the use of gravity;

it permits fluid movement for writers and artists to ergonomically control the position at which to grip pens from holder; and it provides a pen holder that can be handled and squeezed to aid in stress relief of user.

Although the description above comprises many specific details, these should not be construed as limiting the scope of the invention but as simply providing illustrated examples of some of the presently preferred embodiments of this invention. For instance, the pen holder can have other shapes, such as trapezoidal, triangular, circular, etc.; the tapered tubular cavities could be more or less than six; tapered tubular cavity could have different degrees of slopes or be of a single tapered slope etc.; the eraser well can have bosses or cams to hold eraser inside the eraser well; and other implements beside pens can be used such as electronic probes, pencils, router bits, drill bits, etc.

We claim:

1. An article of manufacture for holding various size implements comprising:

a resilient cellular material defining a tapered tubular cavity with one portion of said resilient cellular material open to expose said tapered tubular cavity to ambient atmosphere, whereby said various size implements can be inserted into said tapered tubular cavity producing a sealed portion inside said tapered tubular cavity from ambient atmosphere, whereby writers can subsequently insert/release said various size implements into said tapered tubular cavity with similar insert/release pressures applied to said various size implements.

2. The article of manufacture of claim 1 wherein said resilient cellular material is impermeable to gases or vapors.

3. The article of manufacture of claim 1 wherein said tapered tubular cavity narrows inward from the open portion, whereby center points of implements inserted therein are channeled away from inner wall of said tapered tubular cavity eliminating center point contact with said tapered tubular cavity.

4. The article of manufacture of claim 3 further including a vertical parallel section at the open end of said tapered tubular cavity.

5. The article of manufacture of claim 3 wherein said tapered tubular cavity comprises two gripping zones.

6. The article of manufacture of claim 5 wherein said two gripping zones have slopes that are greater in vertical height than horizontal length in run, whereby implements inserted therein are gripped and held in suspension.

7. The article of manufacture of claim 1 further including a rectangular cavity that is defined by said resilient cellular material with one portion open to exposed said rectangular cavity to ambient atmosphere.

8. The article of manufacture of claim 7 wherein said rectangular cavity has a substantially shaped said resilient cellular material area for providing a variable interference fit with a conventional eraser.

9. The article of manufacture of claim 1 wherein said resilient cellular material is of a substantial shape that is convenient for a human being to grasp.

10. The article of manufacture of claim 9 comprises two concave sides that form a wedge shape, whereby resilient cellular material interlocks with holding device or a human hand.

11. The article of manufacture of claim 1 further including a attaching means for attachment of said resistant cellular material to a planar surface so as to be able to support said resilient cellular material with said various size implements inserted therein on said planar surface with said planar surface intersecting space in any direction.

12. An article of manufacture for holding various size implements comprising:

a resilient cellular material defining a tapered tubular cavity with one portion of said resilient cellular material open to expose said tapered tubular cavity to ambient atmosphere with a resilient skin on the outside surface of said resilient cellular material.

13. The article of manufacture of claim 12 wherein said resilient cellular material and said resilient skin cooperate by a connecting means providing a variable interference fit of said tapered tubular cavity with said various size implements inserted therein.

* * * * *